US006640723B2

(12) United States Patent
Spivak et al.

(10) Patent No.: US 6,640,723 B2
(45) Date of Patent: Nov. 4, 2003

(54) MISSION RESPONSIVE ORDNANCE

(75) Inventors: Timothy Spivak, King George, VA (US); Mark W. Sewell, King George, VA (US); Perry L. Fridley, Jr., King George, VA (US); Michael M. Canaday, King George, VA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 10/103,749

(22) Filed: Mar. 25, 2002

(65) Prior Publication Data

US 2003/0177934 A1 Sep. 25, 2003

(51) Int. Cl.[7] ..... F42B 10/00
(52) U.S. Cl. ..... 102/483
(58) Field of Search ..... 102/393, 489, 102/494, 505, 265, 266, 268, 270, 223, 483

(56) References Cited

U.S. PATENT DOCUMENTS

| | | | | | |
|---|---|---|---|---|---|
| 647,546 | A | * | 4/1900 | Warren | 102/257 |
| 1,017,928 | A | * | 2/1912 | Tocik | 102/506 |
| 2,809,583 | A | * | 10/1957 | Ortynsky et al. | 102/393 |
| 3,981,244 | A | * | 9/1976 | Adimari et al. | 102/489 |
| 4,036,140 | A | * | 7/1977 | Korr et al. | 102/438 |
| 4,264,045 | A | * | 4/1981 | Campbell | 244/164 |
| 4,342,262 | A | * | 8/1982 | Romer et al. | 102/489 |
| 4,480,552 | A | * | 11/1984 | Eckel et al. | 102/393 |
| 4,488,489 | A | | 12/1984 | Schoffl | |
| 4,676,167 | A | * | 6/1987 | Huber et al. | 102/393 |
| 4,714,020 | A | * | 12/1987 | Hertsgaard et al. | 102/351 |
| 4,726,297 | A | * | 2/1988 | Bueno et al. | 102/489 |
| 4,750,423 | A | * | 6/1988 | Nagabhushan | 89/1.51 |
| 4,770,101 | A | * | 9/1988 | Robertson et al. | 102/489 |
| 4,793,260 | A | * | 12/1988 | Kruse et al. | 102/489 |
| 4,899,661 | A | * | 2/1990 | Kaelin | 102/495 |
| 4,920,887 | A | * | 5/1990 | Frehaut et al. | 102/489 |
| 4,922,826 | A | * | 5/1990 | Busch et al. | 102/489 |
| 4,960,055 | A | * | 10/1990 | Dieval | 102/489 |
| 5,005,483 | A | * | 4/1991 | Deffayet | 102/489 |
| 5,076,171 | A | * | 12/1991 | Altenau et al. | 102/489 |
| 5,094,170 | A | * | 3/1992 | Raynaud et al. | 102/489 |
| 5,107,767 | A | * | 4/1992 | Schneider et al. | 102/393 |
| 5,147,973 | A | * | 9/1992 | Ziemba | 102/214 |
| 5,440,994 | A | | 8/1995 | Alexander | |
| 5,473,988 | A | * | 12/1995 | Dion | 102/489 |
| 5,796,031 | A | * | 8/1998 | Sigler | 102/520 |

* cited by examiner

*Primary Examiner*—Charles T. Jordan
*Assistant Examiner*—Jordan Lofdahl
(74) *Attorney, Agent, or Firm*—Matthew J. Bussan, Esq.; James B. Bechtel, Esq.; Peter J. Van Bergen, Esq.

(57) ABSTRACT

A mission responsive ordnance of the present invention arranges a plurality of projectiles in a bundled configuration. The bundled configuration is defined by the projectiles and a bundling means which, together, form a combination that bears loads generated when the bundled configuration strikes and penetrates a target. Unbundling means, coupled to the bundling means, can be operated to selectively render the bundling means inoperative before the target is struck so that one or more of the projectiles are released from their bundled configuration.

44 Claims, 4 Drawing Sheets

FIG.1
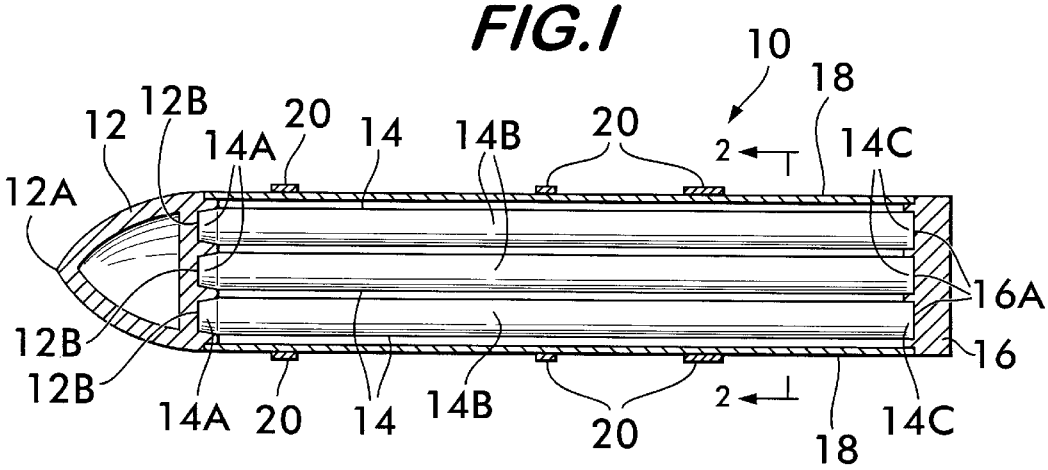
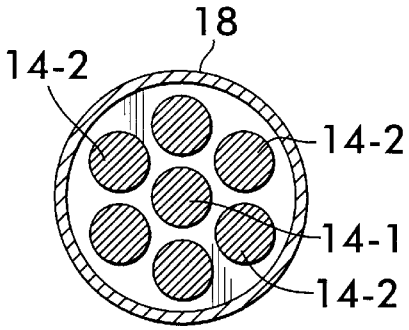
FIG.2
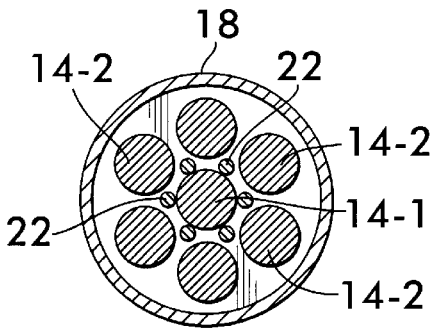
FIG.3
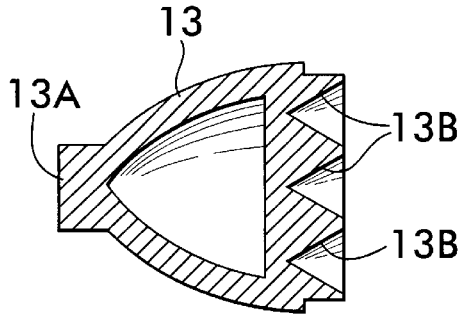
FIG.4
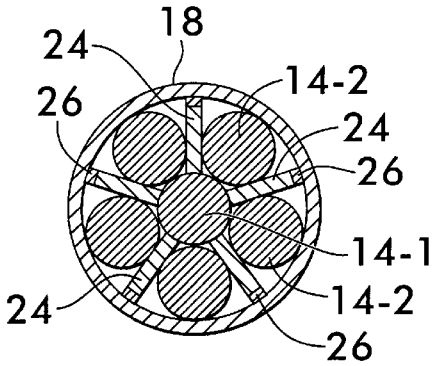
FIG.5

FIG. 6
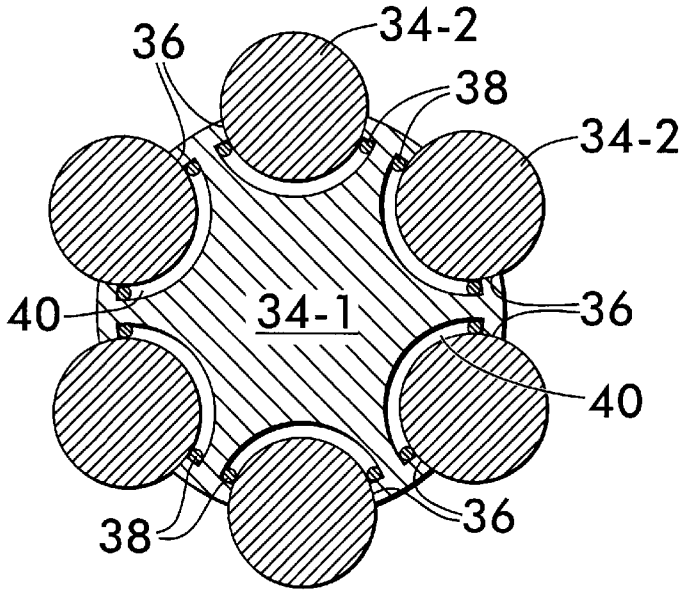
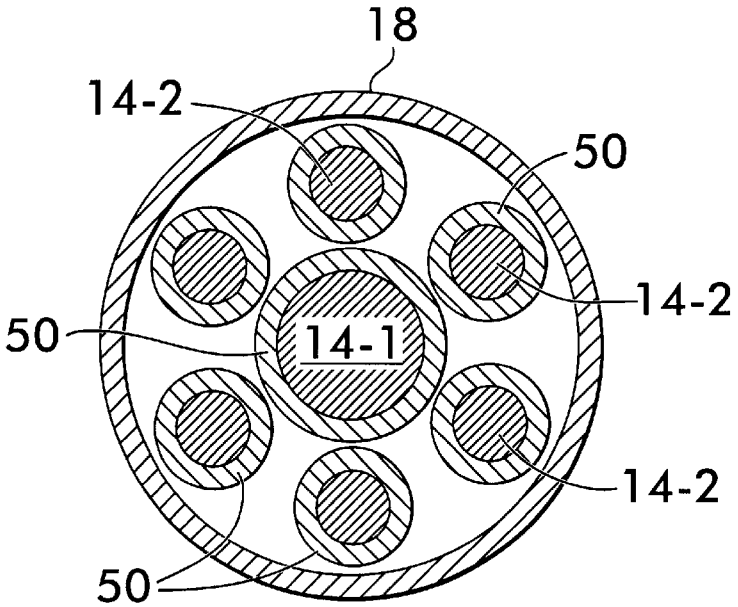
FIG. 7

FIG.8
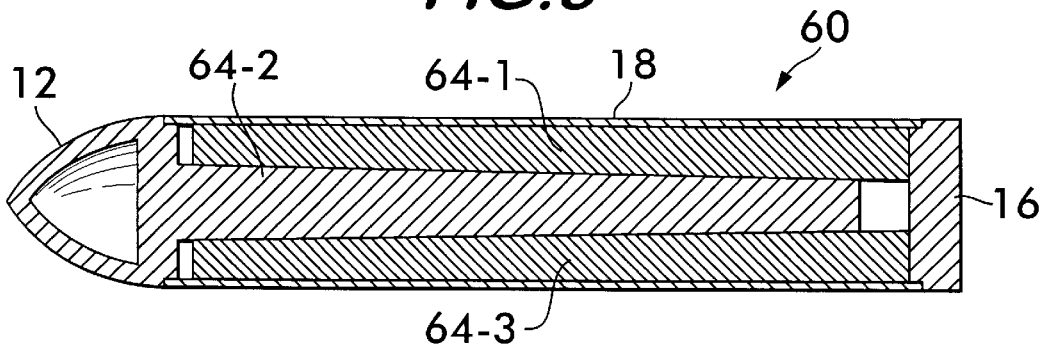
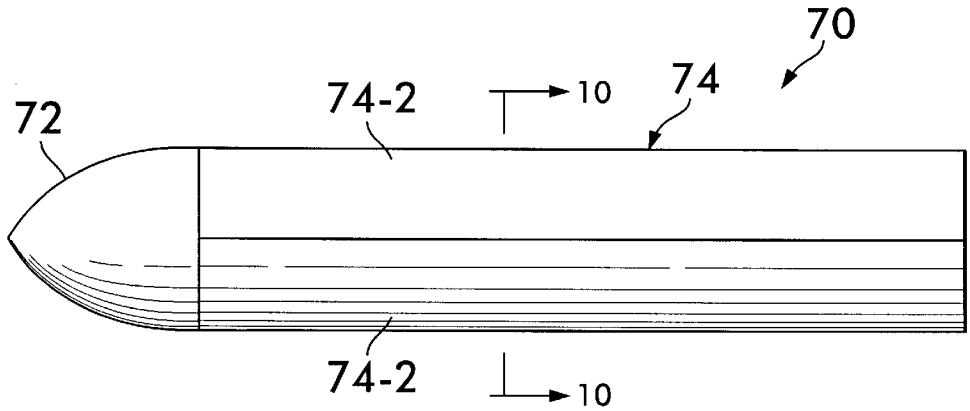
FIG.9
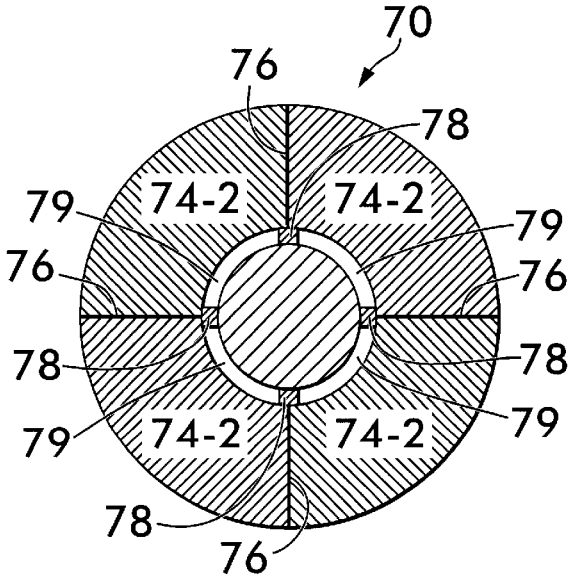
FIG.10

FIG. 11
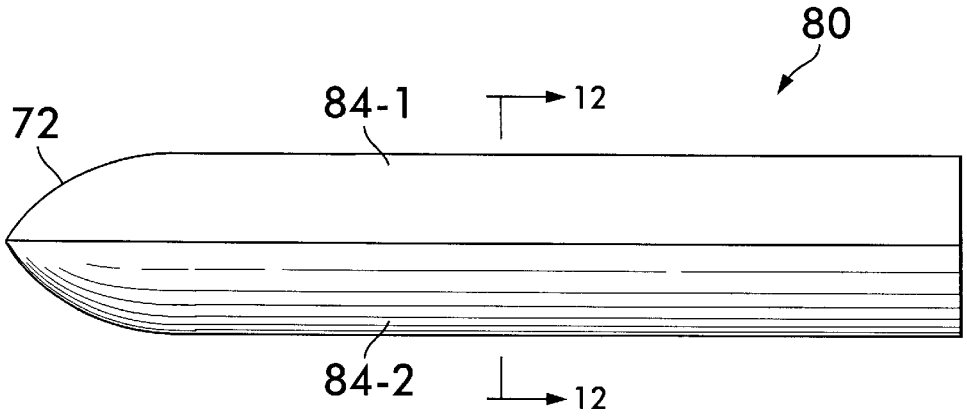
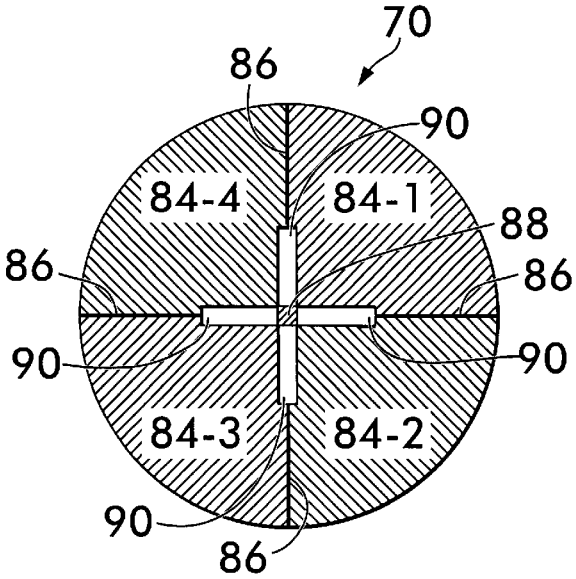
FIG. 12

MISSION RESPONSIVE ORDNANCE

ORIGIN OF THE INVENTION

The invention described herein was made in the performance of official duties by employees of the Department of the Navy and may be manufactured, used, licensed by or for the Government for any governmental purpose without payment of any royalties thereon.

FIELD OF THE INVENTION

The invention relates generally to ordnance, and more particularly to ordnance that can be adapted to a variety of missions after the ordnance has been launched.

BACKGROUND OF THE INVENTION

Historically, strike and support weapons have been designed to kill a specific target class such as hard point targets (e.g., power plants, aircraft shelters, etc.) using kill mechanisms or employment techniques that have very limited effectiveness against other types of target classes to include distributed area and armored targets. As the number of target classes has increased, so has the number of different ordnance payloads. Over time, this has resulted in the development of numerous specialized weapons, some of which require different launch platforms.

In addition to target evolution, recent conflicts have emphasized the need to achieve operation objectives with a minimum impact to the surrounding area. Tactical situations requiring the complete destruction of targets are becoming less and less frequent. Rather, the trend is toward a measured response. For example, in many cases, forces are moving through a hostile area so rapidly that it is only necessary to neutralize the threat and not destroy the area's infrastructure (e.g., roads, bridges, power sources, etc.) that primarily benefits an innocent population. Furthermore, there are the issues associated with friendly, dud sub munitions left in the area. Still, in other cases, it is necessary to disable an area by shutting down a infrastructure for a specified period of time. In this scenario, a measured amount of damage must be brought to bear on a precise pressure point such as a single generator in a power plant or a power distribution switching station. If too much of the power plant is destroyed, an excessive shut down would occur and the strategic objective would not be met. In still other scenarios, the presence of civilians, hospitals or historic/religious sites in close proximity to the intended target means that collateral damage must be minimized. Lastly, the neutralization of sites containing weapons of mass destruction presents a most formidable challenge. Too much damage could cause a release of lethal chemicals/agents into an area inhabited by innocent civilians or even one's own troops.

All of the above-described scenarios call for a weapon that can deliver a measured lethal dose with sufficient precision to kill only the intended target(s). At the same time, large targets that must be totally destroyed will always exist. These targets call for large, non-nuclear payloads, most of which are delivered by cruise missiles or manned aircraft. Thus, future war fighting needs must focus on the ability to defeat various size targets with various levels of attack strength. In all cases, target destruction with minimal collateral damage demands that the ordnance penetrate its target prior to destruction.

The above-described goals of the various war fighting scenarios require a new class of ordnance with the ability to adapt to different types of attacks and different magnitudes of attack strength in response to the key vulnerabilities of a particular target. Such a mission responsive ordnance would reduce the need for target specific weapons and would provide a more robust ordnance capability not easily outdated by target evolution or modifications to tactics.

SUMMARY OF THE INVENTION

Accordingly, it is an object of the present invention to provide a mission responsive ordnance.

Another object of the present invention is to provide a mission responsive ordnance that can be adapted to different kinds of attacks.

Yet another object of the present invention is to provide a mission responsive ordnance that can be adapted to different magnitudes of attack strength.

Still another object of the present invention is to provide a mission responsive ordnance designed to penetrate its target in each of its attack modes.

A still further object of the present invention is to provide a mission responsive ordnance that can operate in either a unitary or subdivided-munitions mode.

Yet another object of the present invention is to provide a mission responsive ordnance that can be delivered to its destination using current launch technology.

Other objects and advantages of the present invention will become more obvious hereinafter in the specification and drawings.

In accordance with the present invention, a mission responsive ordnance includes a plurality of projectiles arranged in a bundled configuration. First bundling means are provided for maintaining the bundled configuration such that the first means and at least a first portion of the projectiles are coupled together to form a combination that bears penetration and deceleration loads generated when the bundled configuration strikes and penetrates a target. Second unbindling means are coupled to at least one of i) the first bundling means and ii) at least a second portion of the projectiles for selectively releasing the second portion of projectiles from the bundled configuration before striking the target.

In a particular embodiment of the present invention, the bundled configuration is maintained by a nose cone assembly, a frangible tubular body and an aft support. The nose cone assembly is located forward of the projectiles and has rearward-facing sockets for capturing therein in a complementary fashion portions of each nose of the projectiles. The frangible tubular body has a forward end coupled to the nose cone assembly and encases the projectiles in their bundled configuration. The aft support is coupled to the aft end of the frangible tubular body. Similar to the nose cone assembly, the aft support has forward-facing sockets for capturing therein in a complementary fashion portions of each of the projectile's tails. The combination of nose cone assembly, frangible tubular body and aft support restricts axial, radial and lateral movement of the projectiles in their bundled configuration. Further, the nose cone assembly, aft support and projectiles bear penetration and deceleration loads generated when the embodiment is operating in a unitary munitions mode. The embodiment could alternatively be operated in a sub-divided munitions mode by fracturing the frangible tubular body before the target is struck. In this mode, some or all of the projectiles are released from their bundled configuration and allowed to disperse to strike a variety of dispersed targets.

BRIEF DESCRIPTION OF THE DRAWINGS

FIG. 1 is a longitudinal cross-sectional view of one embodiment of a mission responsive ordnance in accordance with the present invention;

FIG. 2 is an axial cross-sectional view of the mission responsive ordnance taken along line 2—2 in FIG. 1;

FIG. 3 is an axial cross-sectional view of another mission responsive ordnance in which a core projectile remains with the originally-launched ordnance while peripheral projectiles are released therefrom when the ordnance is used in a subdivided mode;

FIG. 4 is an isolated cross-sectional view of a nose cone having a blunt tip and have pointed sockets for receiving pointed nose cones of projectiles captured by the nose cone;

FIG. 5 is an axial cross-sectional view of another embodiment of the present invention in which axially-extending stiffening webs couple the core projectile to the mission responsive ordnance's outer body;

FIG. 6 is an axial cross-sectional view of another embodiment of the present invention in which a longitudinally-fluted core projectile supports peripheral projectiles and means for expelling each peripheral projectile at time of release;

FIG. 7 is an axial cross-sectional view of still another embodiment of the present invention in which the projectiles are housed within individual launch tube's;

FIG. 8 is a side cross-sectional view of still another embodiment of the present invention in which the projectiles housed by the mission responsive ordnance are wedge-shaped;

FIG. 9 is a side view of another embodiment of the present invention in which a solid projectile section is geometrically subdividable;

FIG. 10 is a cross-sectional view taken along line 10—10 in FIG. 9;

FIG. 11 is a side view of another embodiment of the present invention in which the mission responsive ordnance is entirely subdividable into its geometric constituents; and FIG. 12 is cross-sectional view taken along line 12—12 in FIG. 11.

DETAILED DESCRIPTION OF THE INVENTION

Referring now to the drawings, and more particularly to FIG. 1, an embodiment of a mission responsive ordnance (MRO) in accordance with the present invention is shown and referenced generally by numeral 10. Although not a requirement or limitation of the present invention, MRO 10 would typically have a delivery vehicle (not shown) coupled to its aft end. Such a delivery vehicle could include a propulsion mechanism, control surfaces, and guidance and control mechanisms such as those used on short or long-range missiles. Further, although MRO 10 will be described herein relative to an airborne ordnance, it is to be understood that the inventive principles of the present invention could also be applied in an underwater environment.

At its forward end, MRO 10 has a nose cone 12 designed to penetrate a target when MRO 10 is called upon to act as a unitary ordnance as will be explained further below. As is understood in the art of penetrating ordnance, nose cone 12 can be hollow as shown although this is not a limitation of the present invention. Further, although nose cone 12 has a pointed tip 12A, it could also have a blunt tip to minimize ricochet as is understood in the art.

The aft end of nose cone 12 is configured with a plurality of sockets 12B that face axially rearward from nose cone 12. Each of sockets 12B is sized and shaped to receive, in a complementary fashion, at least a portion of the nose of each of a plurality of projectiles 14 which are illustrated in a side view. The portion of projectiles 14 received in sockets 12B could be mechanically/chemically fuzed/bonded to sockets 12B such that the mechanical/chemical fuze/bond can be broken or eliminated when MRO 10 is to be used in its sub-divided munitions mode.

Each of projectiles 14 is capable of striking and penetrating a target. In general, each of projectiles 14 includes a nose cone 14A at its forward end and a rigid body section 14B coupled to nose cone 14A and extending to an aft end 14C which can be attached to or integrated with rigid. body section 14B. Nose cone 14A can have a blunt tip (as shown) or a pointed tip without departing from the scope of the present invention. Furthermore, any and/or all of projectiles 14 can include an explosive payload, the choice of which is not a limitation of the present invention.

In accordance with the present invention, any and/or all of projectiles 14 also function as a structural component of MRO 10 when MRO 10 is to be utilized as a unitary ordnance. That is, projectiles 14 must withstand strike, penetration and deceleration loads generated when MRO 10 strikes/penetrates a target in its unitary ordnance mode. Accordingly, those of projectiles 14 serving this function must be capable of coupling the deceleration load (passed from nose cone 12) to adjacent projectiles and/or adjacent structural elements. This can be achieved through various physical locking or interlocking mechanisms, or by physically capturing the projectiles between forward and aft components. A physical lock can take the form of fuzed or bonded structural elements where the bond is subsequently broken via mechanical, electrical or chemical means. If interlocking of mechanical parts is used, the interlock can be subsequently released by mechanical, electrical or chemical means. Physical capture of the projectiles can be achieved with axial, lateral and radial capture mechanisms. Various non-limiting examples will be described herein.

One example of a capture mechanism is illustrated in the FIG. 1 embodiment. The forward part of the capture mechanism includes nose cone 12 described above. Located aft of projectiles 14 is an aft support 16 configured with a plurality of sockets 16A that face axially forward towards nose cone 12. Each of sockets 16A is sized and shaped to receive, in a complementary fashion, at least a portion of each aft end 14C of projectiles 14. Thus, nose cone 12 and aft support 16 position, align and capture projectiles 14 laterally and longitudinally in a bundled configuration. The portion of projectiles 14 received in sockets 16A could be mechanically/chemically fuzed/bonded to sockets 16A such that the mechanical/chemical fuze/bond can be broken or eliminated when MRO 10 is to be used in its sub-divided munitions mode.

Physical coupling of nose cone 12 to aft support 16 is accomplished in the illustrated embodiment by a tubular body 18 that essentially encases and radially restrains projectiles 14 in their bundled configuration. Further, the combination of nose cone 12, tubular body 18 and aft support 16 prevents axial movement of projectiles 14 until or unless it is desired for some or all of projectiles 14 to fly free of MRO 10 and act as individual projectiles. Absent the release of projectiles 14, nose cone 12, projectiles 14 and aft support 16 form an integral structural element of MRO 10 operating in its unitary mode.

To take advantage of the sub-divided munitions mode of MRO 10, tubular body 18 must be eliminated or removed during flight of MRO 10. One way of facilitating removal of tubular body 18 during flight is to make tubular body 18 a frangible structure that breaks apart at a selected time during the flight of MRO 10. Thus, tubular body 18 could be a pre-scored metal or composite structure that fractures in a predefined fashion. Such fracturing could be brought about by a fracture initiation charge 20 coupled to, for example, positions along (or about) tubular body 18. Charges 20 could be initiated at a predetermined time/sequence after launch, by means of a radio wave signal, or by other means known in the art. Once tubular body 18 fractures, nose cone 12 and aft support 16 fall away so that projectiles 14 disperse in the air from the bundled configuration. Note that if projectiles 14 are fuzed/bonded into sockets 12B and/or sockets 16A, the fuze/bond must be broken before nose cone 12 and aft support 16 can fall away.

The particular bundled configuration of projectiles 14 is not a limitation of the present invention. However, by way of example, projectiles 14 can be arranged as shown in FIG. 2 with a centrally-positioned core projectile 14-1 and a number of peripheral projectiles 14-2 radially surrounding centrally-positioned core projectile 14-1. The number and/or size of core projectile 14-1 and peripheral projectiles 14-2 are not limitations of the present invention. That is, the core and peripheral projectiles can be the same size or different sizes. Still further, the bundled configuration of projectiles 14 is not limited to a core/peripheral projectile geometry. For example, if three projectiles 14 of equal diameter are used, there would be no core projectile as they could be arranged in a triangular geometry.

In operation, MRO 10 is launched into the air toward specified target(s). If MRO 10 is to be used in its unitary mode, fracture charge 20 could be removed or inactivated prior to or during launch. Upon impact with a target, nose cone 12 transfers impact, and subsequent penetration and deceleration loads, along projectiles 14 and on to aft support 16 as described above. If, however, MRO 10 is to be used in a subdivided mode, some or all of projectiles 14 are released into the air at a prescribed time during flight as described above. The released ones of projectiles 14 then disperse to cover a broader area of targets. Although not shown, each of projectiles 14 released from MRO 10 can be "smart" projectile in operating under control of its own guidance/control mechanisms.

While MRO 10 can be configured to release all of projectiles 14 in a subdivided mode, this need not be the case. For example, as illustrated in FIG. 3, core projectile 14-1 could be surrounded by a rigid frame such as rods 22 that rigidly couple the nose cone (not shown) to the aft support (not shown). In this example, when used in the subdivided mode, core projectile 14-1 would remain integral with the nose cone and aft support while peripheral projectiles 14-2 were released therefrom. (Note that it may be necessary to have the fracturing charge further coupled to the outer periphery of the nose cone of the MRO in order to allow for the radial and/or lateral release of peripheral projectiles 14-2.) Rods 22 would restrain core projectile 14-1 from release and further aid in withstanding strike and penetration forces whether the MRO is used in the unitary or subdivided mode.

Variations on the present invention's mission responsive ordnance approach can be implemented without departing from the scope of the present invention. A number of such variations will be presented herein by way of example. However, it is to be understood that these examples do not represent an exhaustive set of such variations.

With respect to the nose cone of the MRO, it can have a pointed tip as in nose cone 12 or it can have a blunt tip 13A as illustrated in the isolated view of nose cone 13 shown in FIG. 4. Further, as mentioned above, the projectiles captured by the nose cone can have a blunt tip (as evidenced in FIG. 1) or can have a pointed tip. In the case of pointed tip projectiles, sockets 13B are pointed and sized in a complementary fashion to the projectiles (not shown) they are to receive.

Other variations in the present invention relate to the structure used to maintain and/or release the bundled configuration of the projectiles while the MRO is operating in its unitary mode. For example, rather than using a fracturing charge 20 coupled to the exterior of frangible tubular body 18 as described above for MRO 10, the present invention could utilize internally-mounted fracture charges. More specifically, as illustrated in FIG. 5, axially extending stiffening webs 24 can be coupled to core projectile 14-1 and extend radially out to tubular body 18. Stiffening webs 24 can be captured in the MRO's nose cone and aft support, neither of which is illustrated in this view. A fracture charge 26 could be mounted on and along the outboard-end of each web 24. In this embodiment, webs 24 aid in withstanding strike/penetration loads when the MRO is operating in the unitary mode. When the MRO is operating in a subdividing mode, webs 24 serve to position charges 26 and can aid in the directing of peripheral projectiles 14-2 when they are released.

Another variation of the present invention is illustrated in FIG. 6 where core projectile 34-1 has its outer body longitudinally fluted to receive peripheral projectiles 34-2. Each peripheral projectile 34-2 is fuzed to core projectile 34-1 along fuzed joints 36 running the length of the projectiles. In this embodiment, axially-extending expelling charges 38 are positioned radially inward from fused joints 36. The fluting of core projectile 34-1 is such that a gap 40 is formed between each pair of charges 38. If peripheral projectiles 34-2 are to be released, charges 38 are initiated with resulting gases expanding into gap 40. The pressure in gap 40 builds until fuzed joints 36 fail. At this point, the gases act to propel/expel peripheral projectiles 34-2 radially outward.

Still another variation of the present invention is illustrated in FIG. 7 where any and/or all of projectiles 14 (e.g., core projectile 14-1 and peripheral projectiles 14-2) are housed within individual launch tube's 50. Upon fracture of tubular body 18, launch tube's 50 with their housed projectiles are dispersed from the MRO with each launch tube 50 subsequently launching its projectile. The particular choice of launch tube and associated launch mechanism is not part of or a limitation of the present invention and will, therefore, not be described further herein.

Other variations of the present invention relate to the geometry of the projectiles housed by the MRO. For example, as illustrated by MRO 60 in FIG. 8, each of projectiles 64-1, 64-2 and 64-3 define wedge-shaped external geometries. In their bundled configuration, adjacent wedge-shaped projectiles alternate with respect to their direction of taper. That is, for the illustrated example, the tapered end of projectile 64-1 is at the forward end of MRO 60, the tapered end of projectile 64-2 is at the aft end of MRO 60 and the tapered end of projectile 64-3 is at the forward end of MRO 60. In this way, when MRO 60 is to be used in a unitary mode, strike/penetration loads cause projectiles 64-1, 64-2 and 64-3 to lock together.

Another approach to the mission responsive ordnance of the present invention will now be described with the aid of the side view of FIG. 9 and the cross-sectional view of FIG. 10. In FIG. 9, MRO 70 has a penetrating nose cone 72 with a solid cylindrical projectile section 74 coupled thereto.

Projectile section 74 comprises a geometrically subdividable arrangement of individual projectiles. For example, as illustrated in FIG. 10, a cylindrical core projectile 74-1 is surrounded by arc-shaped peripheral projectiles 74-2. Note that the number of peripheral projectiles 74-2 can be fewer or greater in number than that shown. The coupling and uncoupling of the projectiles to/from one another and to/from nose cone 72 can be accomplished by means of fuzed joints 76 and expelling charges 78. Gaps 79 between charges 78 are provided to allow gases from initiated charges 78 to build therein until pressure is sufficient to bring about failure of fuzed joints 76. As with one of the previously-described embodiments, core projectile 74-1 could also be configured to remain with nose cone 72 at all times.

The approach illustrated by MRO 70 could be further extended to MRO 80 illustrated in FIGS. 11 and 12. More specifically, the entirety of MRO 80 is constructed as a solid projectile with each section thereof forming a geometric portion thereof. In the illustrated example, MRO 80 is dividable longitudinally into four sections with each section 84-1, 84-2, 84-3 and 84-4 forming a portion of the nose and body of MRO 80. Coupling and uncoupling of projectile sections could once again be accomplished by means of fuzed joints 86 and a longitudinally extending fracture/expelling charge 88. The gases from charge 88 expands into gaps 90 until joints 86 fail. Note that the size of charge 88 and gaps 90 are exaggerated for purpose of illustration.

The advantages of the present invention are numerous. Recent conflicts have strongly suggested the need for a new form of ordnance that can address the wide spectrum of surface targets and target scenarios that are present around the globe. These scenarios present fixed hard targets as well as mobile and area targets which can be embedded in highly vulnerable civilian settings. This creates a demand for weapons that can deliver a large punch against large hard targets, multiple smaller punches against smaller area targets and light taps against some special targets in highly vulnerable surroundings. The mission responsive ordnance of the present invention offers this capability through the use of novel ordnance configurations that can perform in different modes. In the unitary mode, the ordnance section remains whole to defeat single, large targets (e.g., power plants, communications centers, etc.). In a subwarhead mode, the unitary ordnance section splits into multiple smaller subwarheads that can independently seek smaller ground targets (e.g., missile launchers, radar sites, artillery gun and crew). The choice of mode can be made prior to launch or while the ordnance is enroute.

The multiplicity of options represents a significant shift in conventional strike warfare. It addresses the change in war fighting tactics, the evolving diversity of targeted threats and the need to outfit an arsenal having more firepower for fewer dollars of expenditure. The concepts presented herein indicate potential for high payoffs in war fighting capability given specific investments in the ordnance technology base. Analysis against current threat targets indicates a 40 to 80 percent reduction in sorties required for target destruction as compared with current cruise missiles.

In summary, specific benefits of the present invention include increased effectiveness against a broad set of targets, reduction of weapon types through mission consolidation, ability to focus kill mechanisms on the most vulnerable point of specific targets, the ability to minimize collateral damage and the ability to defeat multiple targets. The potential for growth in capability is tremendous given development of additional technologies.

Although the invention has been described relative to a specific embodiment thereof, there are numerous variations and modifications that will be readily apparent to those skilled in the art in light of the above teachings. It is therefore to be understood that, within the scope of the appended claims, the invention may be practiced other than as specifically described.

What is claimed as new and desired to be secured by Letters Patent of the United States is:

What is claimed is:

1. A mission responsive ordnance, comprising:

a plurality of projectiles arranged in a bundled configuration, said plurality of projectiles defined by a core projectile and a plurality of peripheral projectiles distributed radially about said core projectile;

first means for maintaining said bundled configuration with said first means and said plurality of projectiles coupled together to form, in a unitary mode of operation, an integral structural element that bears loads generated when said bundled configuration strikes and penetrates a target; and second means coupled to said first means for, in a subdivided mode of operation, selectively rendering said first means inoperative before a target is struck wherein said plurality of projectiles are released from said bundled configuration into a surrounding environment.

2. A mission responsive ordnance as in claim 1 wherein said core projectile comprises an explosive projectile.

3. A mission responsive ordnance as in claim 1 wherein each of said plurality of peripheral projectiles comprises an explosive projectile.

4. A mission responsive ordnance as in claim 1 wherein said first means restricts axial, radial and lateral movement of said plurality of projectiles in said bundled configuration.

5. A mission responsive ordnance as in claim 1 wherein said first means comprises:

a nose cone located forward of said plurality of projectiles in said bundled configuration;

a tubular body having a forward end and an aft end, said tubular body coupled on said forward end thereof to said nose cone and encasing said plurality of projectiles in said bundled configuration; and an aft support coupled to said aft end of said tubular body wherein a combination of said nose cone, said tubular body and said aft support restricts axial and radial movement of said plurality of projectiles in said bundled configuration.

6. A mission responsive ordnance as in claim 5 wherein said nose cone is configured to receive a portion of each of said plurality of projectiles therein.

7. A mission responsive ordnance as in claim 1 wherein said first means comprises:

a nose cone; and an open framework coupled to said nose cone and extending aft therefrom for individually supporting each of said plurality of projectiles in said bundled configuration wherein a combination of said nose cone and said open framework restricts axial and radial movement of said plurality of projectiles in said bundled configuration.

8. A mission responsive ordnance as in claim 7 wherein said nose cone is configured to receive a portion of each of said plurality of projectiles therein.

9. A mission responsive ordnance as in claim 1 further comprising a launch tube assembly individually housing each of said plurality of projectiles, wherein each said launch tube assembly and its corresponding projectile are selectively released from said bundled configuration before striking the target, each said launch tube assembly subsequently launching its corresponding projectile.

10. A mission responsive ordnance as an claim 1 wherein said second means includes means for expelling each of said plurality of projectiles radially outward.

11. A mission responsive ordnance, comprising:

a plurality of individually explosive projectiles arranged in a bundled configuration, said plurality of projectiles defined by a core projectile and a plurality of peripheral projectiles distributed radially about said core projectile;

first means for maintaining said bundled configuration with said first means and said plurality of individually explosive projectiles coupled together to form, in a unitary mode of operation, an integral structural element that bears loads generated when said bundled configuration strikes and penetrates a target; and second means coupled to said first means for, in a subdivided mode of operation, selectively rendering said first means inoperative before a target is struck wherein said plurality of individually explosive projectiles are released from said bundled configuration into a surrounding environment.

12. A mission responsive ordnance as in claim 11 wherein said first means restricts axial, radial and lateral movement of said plurality of projectiles in said bundled configuration.

13. A mission responsive ordnance as in claim 11 wherein said first means comprises:

a nose cone located forward of said plurality of projectiles in said bundled configuration;

a tubular body having a forward end and an aft end, said tubular body coupled on said forward end thereof to said nose cone and encasing said plurality of projectiles in said bundled configuration; and an aft support coupled to said aft end of said tubular body wherein a combination of said nose cone, said tubular body and said aft support restricts axial and radial movement of said plurality of projectiles in said bundled configuration.

14. A mission responsive ordnance as in claim 13 wherein said nose cone is configured to receive a portion of each of said plurality of projectiles therein.

15. A mission responsive ordnance as in claim 11 wherein said first means comprises:

a nose cone; and an open framework coupled to said nose cone and extending aft therefrom for individually supporting each of said plurality of projectiles in said bundled configuration wherein a combination of said nose cone and said open framework restricts axial and radial movement of said plurality of projectiles in said bundled configuration.

16. A mission responsive ordnance as in claim 15 wherein said nose cone is configured to receive a portion of each of said plurality of projectiles therein.

17. A mission responsive ordnance as in claim 11 further comprising a launch tube assembly individually housing each of said plurality of projectiles, wherein each said launch tube assembly and its corresponding projectile are selectively released from said bundled configuration before striking the target, each said launch tube assembly subsequently launching its corresponding projectile.

18. A mission responsive ordnance as in claim 11 wherein said second means includes means for expelling each of said plurality of projectiles radially outward.

19. A mission responsive ordnance, comprising:

a plurality of projectiles arranged in a bundled configuration, said plurality of projectiles defined by a core projectile and a plurality of peripheral projectiles distributed radially about said core projectile;

first means disposed about said bundled configuration for maintaining said bundled configuration with said first means and said plurality of projectiles coupled together to form, in a unitary mode of operation, an integral structural element that bears loads generated when said bundled configuration strikes and penetrates a target; and second means coupled to said first means for, in a subdivided mode of operation, selectively rendering said first means inoperative before a target is struck wherein said plurality of projectiles are released from said bundled configuration into a surrounding environment.

20. A mission responsive ordnance as in claim 19 wherein said core projectile comprises an explosive projectile.

21. A mission responsive ordnance as in claim 19 wherein each of said plurality of peripheral projectiles comprises an explosive projectile.

22. A mission responsive ordnance as in claim 19 wherein said first means restricts axial, radial and lateral movement of said plurality of projectiles in said bundled configuration.

23. A mission responsive ordnance as in claim 19 wherein said first means comprises:

a nose cone located forward of said plurality of projectiles in said bundled configuration;

a tubular body having a forward end and an aft end, said tubular body coupled on said forward end thereof to said nose cone and encasing said plurality of projectiles in said bundled configuration; and an aft support coupled to said aft end of said tubular body wherein a combination of said nose cone, said tubular body and said aft support restricts axial and radial movement of said plurality of projectiles in said bundled configuration.

24. A mission responsive ordnance as in claim 23 wherein said nose cone is configured to receive a portion of each of said plurality of projectiles therein.

25. A mission responsive ordnance as in claim 19 further comprising a launch tube assembly individually housing each of said plurality of projectiles, wherein each said launch tube assembly and its corresponding projectile are selectively released from said bundled configuration before striking the target, each said launch tube assembly subsequently launching its corresponding projectile.

26. A mission responsive ordnance as in claim 19 wherein said second means includes means for expelling each of said plurality of projectiles radially outward.

27. A mission responsive ordnance, comprising:

a plurality of projectiles arranged in a bundled configuration, said plurality of projectiles defined by a core projectile and a plurality of peripheral projectiles distributed radially about said core projectile;

first means for maintaining said bundled configuration with said first means and said plurality of projectiles coupled together to form, in a unitary mode of operation, an integral structural element that bears loads generated when said bundled configuration strikes and penetrates a target; and second means coupled to said first means for, in a subdivided mode of operation, selectively rendering said first means inoperative before a target is struck, said second means further coupled to at least a portion of said plurality of said projectiles for expelling each of said projectiles from said bundled configuration into a surrounding environment.

28. A mission responsive ordnance as in claim 27 wherein said core projectile comprises an explosive projectile.

29. A mission responsive ordnance as in claim 27 wherein each of said plurality of peripheral projectiles comprises an explosive projectile.

30. A mission responsive ordnance as in claim 27 wherein said first means restricts axial, radial and lateral movement of said plurality of projectiles in said bundled configuration.

31. A mission responsive ordnance as in claim 27 wherein said first means comprises:

a nose cone located forward of said plurality of projectiles in said bundled configuration;

a tubular body having a forward end and an aft end, said tubular body coupled on said forward end thereof to said nose cone and encasing said plurality of projectiles in said bundled configuration; and an aft support coupled to said aft end of said tubular body wherein a combination of said nose cone, said tubular body and said aft support restricts axial and radial movement of said plurality of projectiles in said bundled configuration.

32. A mission responsive ordnance as in claim 31 wherein said nose cone is configured to receive a portion of each of said plurality of projectiles therein.

33. A mission responsive ordnance as in claim 27 wherein said first means comprises:

a nose cone; and an open framework coupled to said nose cone and extending aft therefrom for individually supporting each of said plurality of projectiles in said bundled configuration wherein a combination of said nose cone and said open framework restricts axial and radial movement of said plurality of projectiles in said bundled configuration.

34. A mission responsive ordnance as in claim 33 wherein said nose cone is configured to receive a portion of each of said plurality of projectiles therein.

35. A mission responsive ordnance as in claim 27 further comprising a launch tube assembly individually housing each of said plurality of projectiles, wherein each said launch tube assembly and its corresponding projectile are selectively released from said bundled configuration before striking the target, each said launch tube assembly subsequently launching its corresponding projectile.

36. A mission responsive ordnance, comprising:

a plurality of projectiles arranged in a bundled configuration, each of said plurality of projectiles having a nose and a tail;

a nose cone assembly located forward of said plurality of projectiles in said bundled configuration, said nose cone assembly having rearward-facing sockets for capturing therein in a complementary fashion portions of each said nose from said plurality of projectiles;

a frangible tubular body having a forward end and an aft end, said frangible tubular body coupled on said forward end thereof to said nose cone assembly and encasing said plurality of projectiles in said bundled configuration;

an aft support coupled to said aft end of said frangible tubular body, said aft support having forward-facing sockets for capturing therein in a complementary fashion portions of each said tail from said plurality of projectiles wherein a combination of said nose cone assembly, said frangible tubular body and said aft support restricts axial, radial and lateral movement of said plurality of projectiles in said bundled configuration, and wherein said nose cone assembly, said aft support and said plurality of projectiles bear loads generated when said combination and said plurality of projectiles in said bundled configuration strike and penetrate a target; and means for selectively fracturing said frangible tubular body before striking the target wherein said combination disperses to thereby release said plurality of projectiles from said bundled configuration.

37. A mission responsive ordnance as in claim 36 wherein at least a portion of said plurality of projectiles are explosive projectiles.

38. A mission responsive ordnance as in claim 36 wherein said plurality of projectiles comprises:

a core projectile; and a plurality of peripheral projectiles distributed radially about said core projectile.

39. A mission responsive ordnance as in claim 38 wherein said core projectile comprises an explosive projectile.

40. A mission responsive ordnance as in claim 38 wherein each of said plurality of peripheral projectiles comprises an explosive projectile.

41. A mission responsive ordnance as in claim 36 wherein said nose cone assembly has a pointed tip.

42. A mission responsive ordnance as in claim 36 wherein said nose cone assembly has a blunt tip.

43. A mission responsive ordnance as in claim 36 wherein each said nose of said plurality of projectiles is pointed.

44. A mission responsive ordnance as in claim 36 wherein each said nose of said plurality of projectiles is blunt.

* * * * *